United States Patent [19]

Kaufman et al.

[11] 4,439,000

[45] Mar. 27, 1984

[54] SURFACE MOUNT/DAUGHTER BOARD CONNECTOR

[75] Inventors: John W. Kaufman, Hershey; William J. Stape, Lewisberry; Patrick F. Yeager, Middletown, all of Pa.

[73] Assignee: AMP Incorporated, Harrisburg, Pa.

[21] Appl. No.: 364,166

[22] Filed: Mar. 31, 1982

[51] Int. Cl.[3] ..... H01R 9/09

[52] U.S. Cl. ..... 339/176 MP; 339/17 LM

[58] Field of Search ..... 339/176 MP, 17 LM, 17 M, 339/17 LC, 176 M

[56] References Cited

U.S. PATENT DOCUMENTS

| | | | |
|---|---|---|---|
| 3,208,028 | 9/1965 | Mittler et al. | 339/258 P |
| 3,365,694 | 1/1968 | Parker | 339/17 F |
| 3,475,657 | 10/1969 | Knowles | 339/176 MP |
| 3,601,785 | 8/1971 | Longenecker et al. | 339/256 SP |
| 3,651,432 | 3/1972 | Henschen et al. | 339/97 R |
| 3,651,444 | 3/1972 | Desso et al. | 339/17 L |
| 3,715,706 | 2/1973 | Michel et al. | 339/17 LM |
| 3,902,776 | 9/1975 | Williams et al. | 339/17 LM |
| 3,953,096 | 4/1976 | Williams | 339/176 MP |
| 3,966,290 | 6/1976 | Little et al. | 339/17 LC |
| 4,087,146 | 5/1978 | Hudson, Jr. | 339/17 LC |
| 4,133,592 | 1/1979 | Cobaugh et al. | 339/176 MP |
| 4,186,988 | 2/1980 | Kobler | 339/176 MP |
| 4,357,066 | 11/1982 | Cairns et al. | 339/176 MP |

FOREIGN PATENT DOCUMENTS

| | | | |
|---|---|---|---|
| 1001569 | 8/1965 | United Kingdom | 339/176 MP |

*Primary Examiner*—Joseph H. McGlynn
*Assistant Examiner*—Gary F. Paumen
*Attorney, Agent, or Firm*—Allan B. Osborne; Russell J. Egan

[57] ABSTRACT

A surface mount connector is disclosed for electrically and mechanically interconnecting a mother circuit board with a daughter circuit board. The connector has an elongated housing with an inverted T profile, the cross bar of which engages the mother circuit board and the leg of which has a slot to receive the daughter circuit board. A plurality of terminals are mounted in the connector, each terminal having a first portion lying exposed in the slot and a second portion exposed from the cross bar.

1 Claim, 3 Drawing Figures

SURFACE MOUNT/DAUGHTER BOARD CONNECTOR

The present invention is related to a mother/daughter board connector, and in particular, to one which can be readily removed from the mother board should that need arise.

Typical mother/daughter circuit board connectors are represented by U.S. Pat. Nos. 3,902,776; 3,651,444; and 3,966,290. The first of these patents relates to a series of free standing terminals which are soldered to the mother board in a row with portions of the terminals forming a channel which receives the daughter board therein to make both electrical and mechanical contact therewith. The second noted patent is a slightly different arrangement in which a plurality of individual terminals are inserted into a housing and then the housing is mounted on the mother circuit board with the terminals fixedly secured thereto by soldering. The daughter board is received in the housing, which helps to support it in a positon normal to the mother board, and the terminals engage the daughter circuit board. The third of the noted patents shows a two piece mother/daughter board connecter in which a first connector member is mounted on the mother circuit board and a second connector member is mounted on the daughter circuit board, both members being secured to their respective boards by soldering. While each of the devices disclosed in the above noted patents are in their own way functional and successful, they do have certain inherent problems, namely, they are extremely difficult to replace and/or repair due to the fact that the terminals are, in each case, soldered to at least one of the circuit boards.

The present invention is a surface mount connector for joining mother/daughter circuit boards. The subject connector can be detachably mounted on either the mother or daughter circuit board for ready mating with the other board. Thus, a more versatile and adaptable system is provided. The subject connector has a housing of insulative material having an elongated daughter board receiving groove and a mother board mounting surface defined by two laterally extending flanges running the length of the housing and extending normal to the direction of the groove. A plurality of terminal passages are formed in the housing, each extending along a portion of a sidewall of a groove and across the portion of the mother board mounting face. A like plurality of terminals is provided with each terminal having first and second portions connected together by a bight and extending normal to one another. The first portion is channel shaped with a blade formed extending from the base of the channel, in cantilever fashion, with the free end thereof restrained by tines inwardly directed from the sidewalls. The second portion of each terminal has a base and a blade folded back upon the base with the free end thereof captured between restraining ears. The housing also is provided with means for detachably mounting it on the mother board.

The present invention will be described by way of non-limiting example with reference to the accompanying drawings in which.

Figure 1:
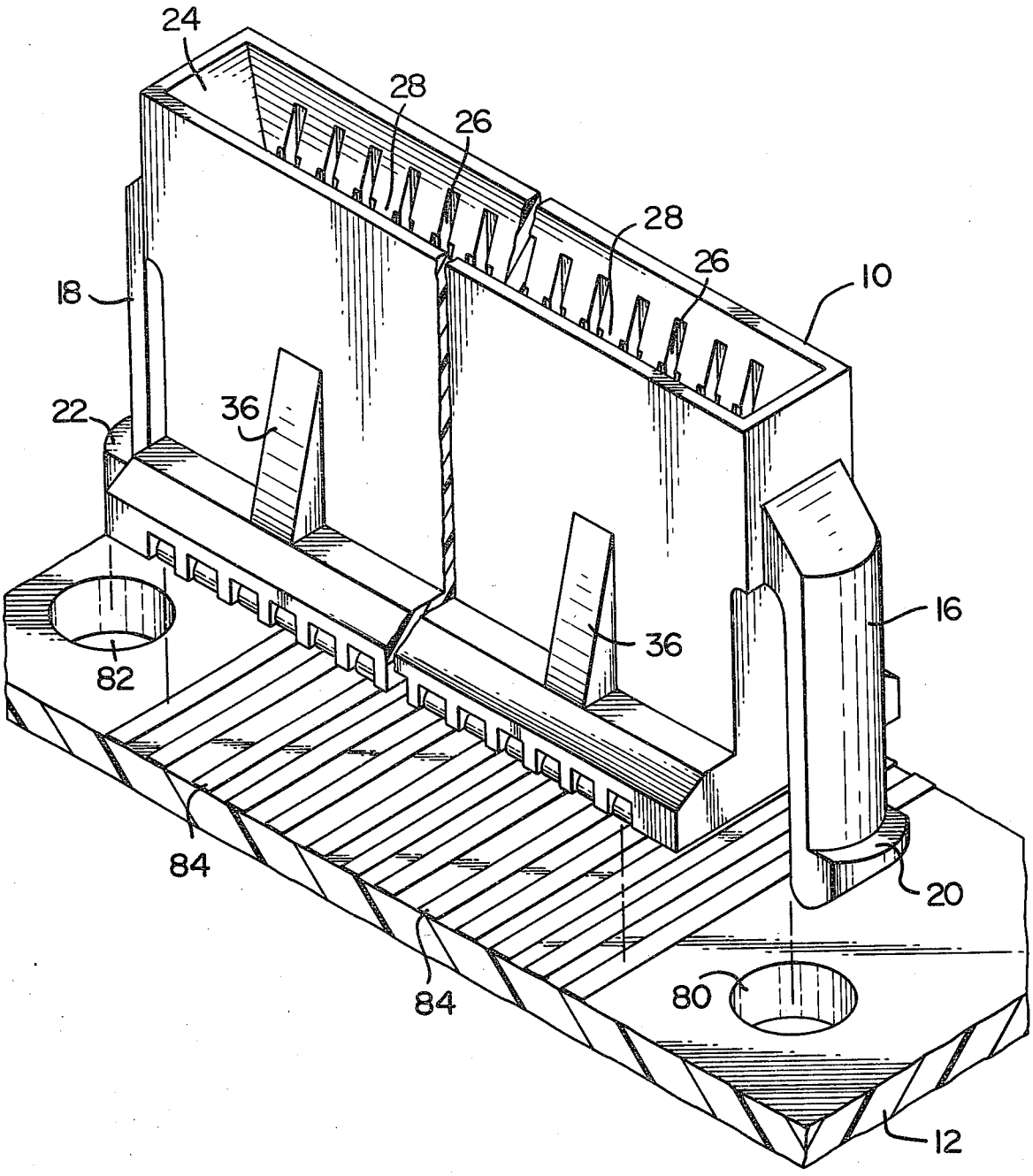
FIG. 1 is a perspective view of the subject invention exploded from a mother board.
Figure 2:
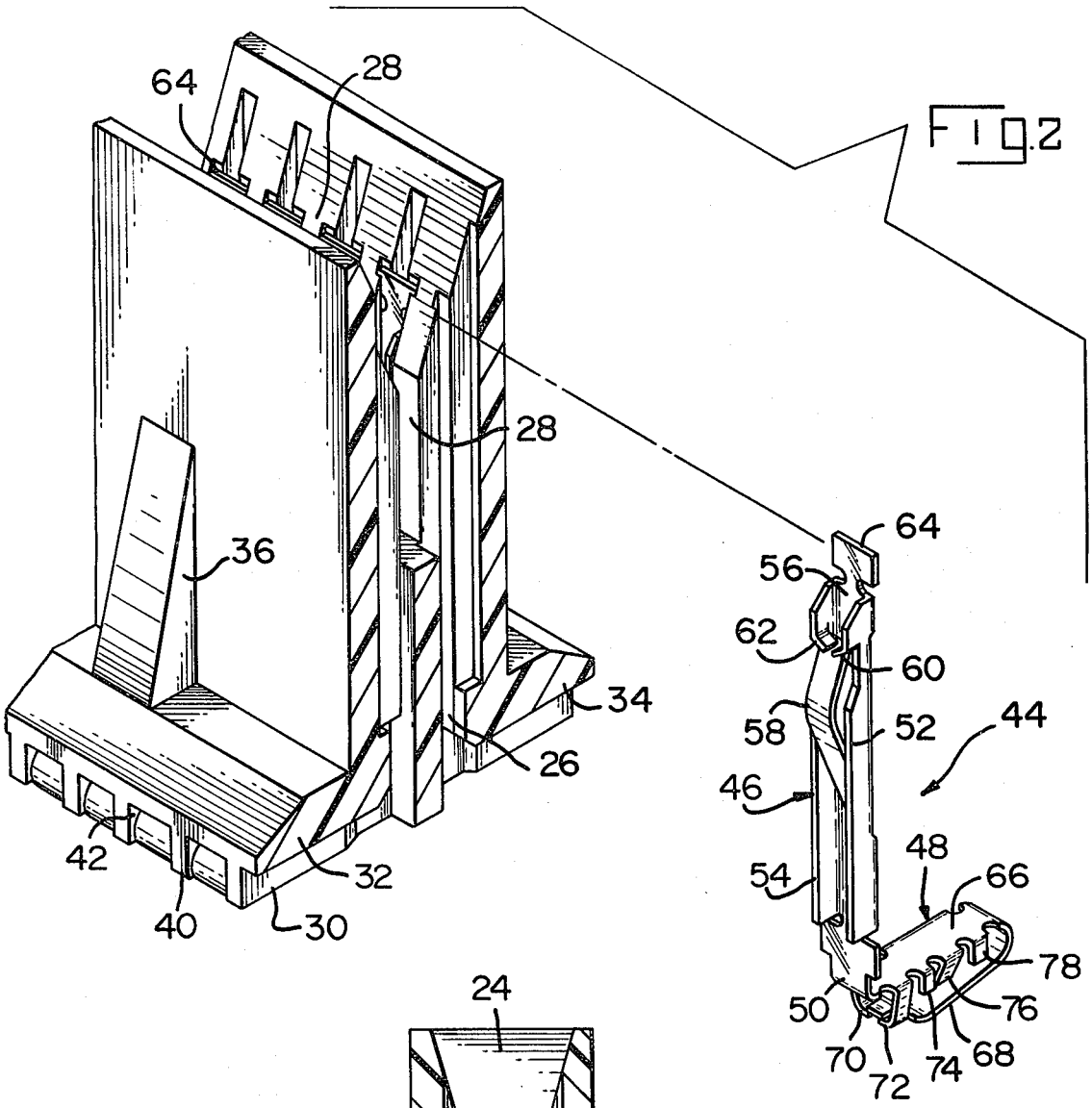
FIG. 2 is a perspective view through a transverse section of the present invention with a terminal exploded therefrom.
Figure 3:
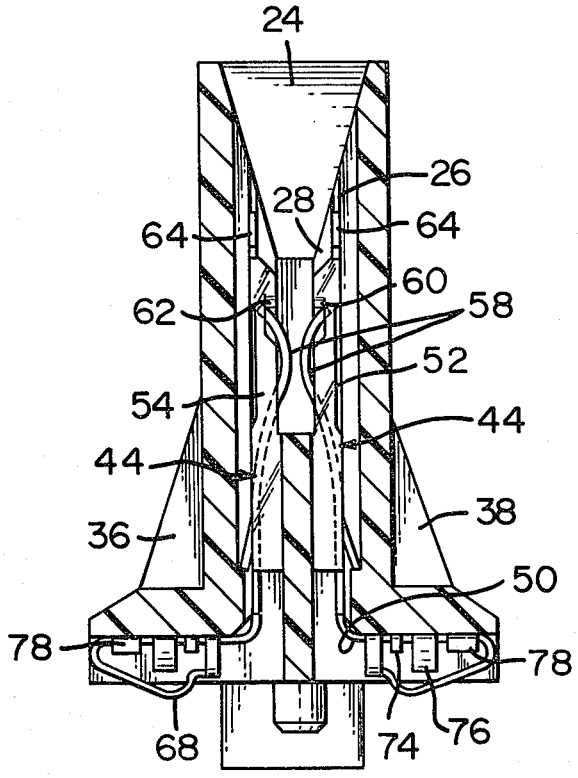
FIG. 3 is a transverse vertical section through the connector of the present invention.

The subject surface mount mother/daughter board connector 10 is to be mounted on a mother circuit board 12 to receive a daughter circuit board (not shown) therein making electrical and mechanical interconnection between the two.

The subject connector 10 includes a housing 14 which is an elongated member of insulative material having a mounting leg 16, 18 at the opposite ends thereof. Each leg 16, 18 has an outwardly directed shoulder 20, 22, respectively, at the free end. The housing 14 also defines an elongated daughter board receiving cavity 24 having a plurality of profiled terminal passages 26 on either side thereof. The passages 26 each open inwardly onto the cavity 24 and adjacent passages are separated by integral flanges 28. The housing also has a mating face 30 which is defined by a pair of integral outwardly directed flanges 32, 34 extending normal to the axis of the cavity 24 so that the housing 14 has an inverted T profile. Abutments 36, 38 serve to strengthen flanges 32, 34, respectively. The mating face 30 has a plurality of integral teeth 40 which define a plurality of channels 42 extending normal to the cavity 24. Each channel 42 intersects a respective passage 26.

A plurality of terminals 44 are provided in the housing 14. Each terminal 44 has a first portion 46 and a second portion 48 extending normal thereto and connected by a bight 50. The first portion 46 is channel shaped having sidewalls 52, 54 and a base 56 from which a beam 58 has been struck in cantilever fashion, with the end of the beam restrained by tomes 60, 62 inwardly directed from the sidewalls 52, 54, respectively. At least one stabilizing flange 64 is provided on the first portion 46. The second portion 48 has a base 66 and a spring arm 68 bent back upon the base 66 in cantilever fashion with the free end thereof restrained by the fkanges 70, 72. Further, flanges 74, 76 and 78 are upstanding from the base 66 and serve to both strengthen the base and limit the inward flexure of the arm 68.

The mother circuit board 12 is provided with a pair of spaced holes 80, 82 which receive therein, respectively, the mounting legs 16, 18. The mother board also is provided with a plurality of circuit paths 84 which are spaced apart a distance equal to the respective terminals 44 of the connector 10.

The terminals 44 are inserted into the connector housing 14 from the mating face 30 with the first portions 46 lying in the passages 26 and the second portions 48 lying in the channels 42. In this position the beams 58 extend into the cavity 24 so as to engage the circuit pads of the daughter board (not shown) and the spring arms 68 project beneath the mating face 30 so as to engage the circuit pads 84 of the mother board 12. It will be noted that as the connector 10 is applied to the mother board there will be a deflection of the spring arms 68 which will cause a wiping action to break any oxide coatings that develop on the mother circuit board paths 84. Likewise, the beams 58 will cause a wiping action when the daughter board (not shown) is inserted into the connector 10. The stabilizing flanges 64 of the terminals will aid in properly aligning the terminals as they are inserted into the respective passages 26.

While legs have been shown as mounting means for the present connector housing, it is clear that other known mounting means utilizing nuts and bolts and similar hardware could readily be substituted therefore.

We claim:

1. A surface mount connector for electrically interconnecting circuits on a daughter card and mother board, comprising:

a. an inverted T-shaped housing having a card receiving cavity along the top surface thereof and laterally extending surfaces along each side adjacent the bottom surface, terminal receiving passages opening into the cavity along either side thereof, and further terminal receiving channels extending along the bottom of the laterally extending surfaces normal to the cavity and in registration with the passages; and b. a plurality of L-shaped terminals having a daughter card engaging portion positioned in the passages and a mother board engaging portion positioned in the channels.

* * * * *